US011219997B1

(12) United States Patent
Carvalho

(10) Patent No.: US 11,219,997 B1
(45) Date of Patent: Jan. 11, 2022

(54) PORTABLE WALL SUPPORTED TOOL HOLDER

(71) Applicant: Artur Carvalho, Toronto (CA)

(72) Inventor: Artur Carvalho, Toronto (CA)

( * ) Notice: Subject to any disclaimer, the term of this patent is extended or adjusted under 35 U.S.C. 154(b) by 0 days.

(21) Appl. No.: 17/109,395

(22) Filed: Dec. 2, 2020

(51) Int. Cl.
*E06C 7/14* (2006.01)
*B25H 3/04* (2006.01)
*B25H 3/06* (2006.01)
*A47B 96/06* (2006.01)

(52) U.S. Cl.
CPC ..... *B25H 3/04* (2013.01); *A47B 96/06* (2013.01); *B25H 3/06* (2013.01); *E06C 7/14* (2013.01)

(58) Field of Classification Search
CPC .... B25H 3/04; B25H 3/06; E06C 7/14; E06C 7/143
See application file for complete search history.

(56) References Cited

U.S. PATENT DOCUMENTS 1,114,921 A * 10/1914 Selstad ..... E06C 7/14 248/210
2,035,639 A * 3/1936 Davis ..... B60S 5/00 211/86.01
3,246,867 A * 4/1966 Ewing ..... E06C 7/14 248/210
3,980,264 A * 9/1976 Tomasik ..... E06C 7/14 248/210
5,333,823 A * 8/1994 Joseph ..... B44D 3/14 182/129
5,511,753 A * 4/1996 Lage ..... B44D 3/14 220/737
5,673,885 A * 10/1997 Pham ..... E06C 7/14 182/129
5,881,891 A * 3/1999 Murphy, Jr. ..... A47L 13/51 211/70.6
6,431,509 B1 8/2002 Proulx
6,848,540 B2 * 2/2005 Kvam ..... E06C 7/14 182/121
7,240,910 B2 * 7/2007 Stuemke ..... B62B 5/06 280/47.26
9,045,940 B2 * 6/2015 Walters ..... E06C 7/143
9,314,008 B2 * 4/2016 DeSpiegelaere ..... A01K 97/06
9,601,036 B2 3/2017 Barnard
2003/0196855 A1 * 10/2003 Kvam ..... E06C 7/14 182/129

(Continued)

*Primary Examiner* — Kimberley S Wright
(74) *Attorney, Agent, or Firm* — Sanchelima & Associates, P.A.; Christian Sanchelima; Jesus Sanchelima

(57) ABSTRACT

A system for a portable wall supported tool holder including a bracket assembly and a receptable assembly is disclosed. The bracket assembly includes a bracket having a first tubular bar with a rod extending perpendicularly therefrom. The bracket also includes a second tubular bar with a rod extending perpendicularly therefrom. The second tubular bar slidably engages the first tubular bar. The two rods are parallel to one another and engage a wall therebetween. One of the rods has a support post extending perpendicularly outward that supports an angularly adjustable joint having a receptacle shelf providing a support surface attached thereto. The receptacle shelf has a cylindrical receptacle extending upward to receive a bucket and a small shelf extending from the side of the bucket receptacle to receive tools.

20 Claims, 3 Drawing Sheets

(56) References Cited

U.S. PATENT DOCUMENTS

| | | | | |
|---|---|---|---|---|
| 2004/0217238 | A1* | 11/2004 | Chochinov | B65F 1/068 248/99 |
| 2008/0061201 | A1* | 3/2008 | Sasser | E06C 7/14 248/210 |
| 2014/0014797 | A1* | 1/2014 | McSherry | F16B 2/12 248/231.41 |
| 2014/0353446 | A1* | 12/2014 | Walters | E06C 7/143 248/238 |

* cited by examiner

PORTABLE WALL SUPPORTED TOOL HOLDER

BACKGROUND OF THE INVENTION

1. Field of the Invention

The present invention relates to a tool holder, more particularly, to a portable wall supported tool holder that maintains the necessary tools of a user readily available for more efficient work.

2. Description of the Related Art

Several designs for tool holders have been designed in the past. None of them, however, include a wall supported container bracket comprising a first tubular bar with a rod extending perpendicularly therefrom and a second bar with a rod extending perpendicularly therefrom, wherein the second bar slidably engages the first bar and the two rods are parallel to one another. The one of the rods has a post extending perpendicularly outward that supports an angularly adjustable joint having a shelf-like support surface attached thereto. The shelf has a cylindrical receptacle extending upward to receive a bucket and a small shelf extending from the side of the bucket receptacle.

Applicant believes that a related reference corresponds to U.S. Pat. No. 9,601,036 for an adjustable clamping support bracket assembly. Applicant believes that another related reference refers to U.S. Pat. No. 6,431,509 for a paint can holder that is configured to maintain its position using the weight of the paint can. None of these references, however, teach of a device that can be adjusted to fit onto a wall and includes receptable a receptacle for holding a bucket. Additionally, extending from the bucket is a shelf to secure tools thereto.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a tool holder that is detachably secured to a wall.

It is another object of this invention to provide a tool holder that is portable.

It is still another object of the present invention to provide a tool holder that readily maintains tools available to a user for more efficient work.

It is also another object of the present invention to provide a tool holder that helps to maintain tools organized.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
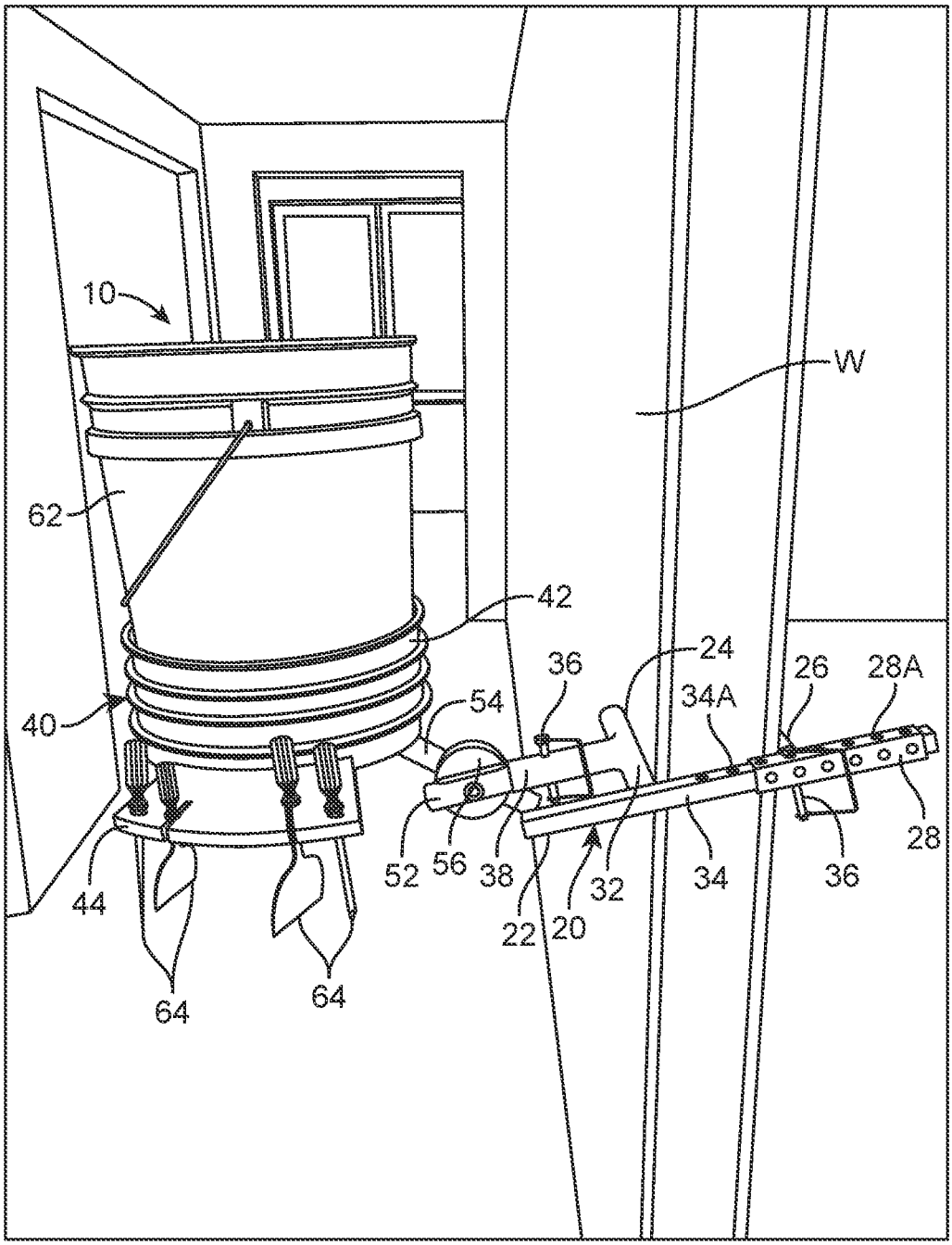
FIG. 1 represents an operation setting, wherein the told holder 10 is secured to and supported by a wall W.

Referring now to the drawings, where the present invention is generally referred to with numeral 10, it can be observed that it, a tool holder 10, basically includes a bracket assembly 20 and a receptacle assembly 40.

Figure 2:
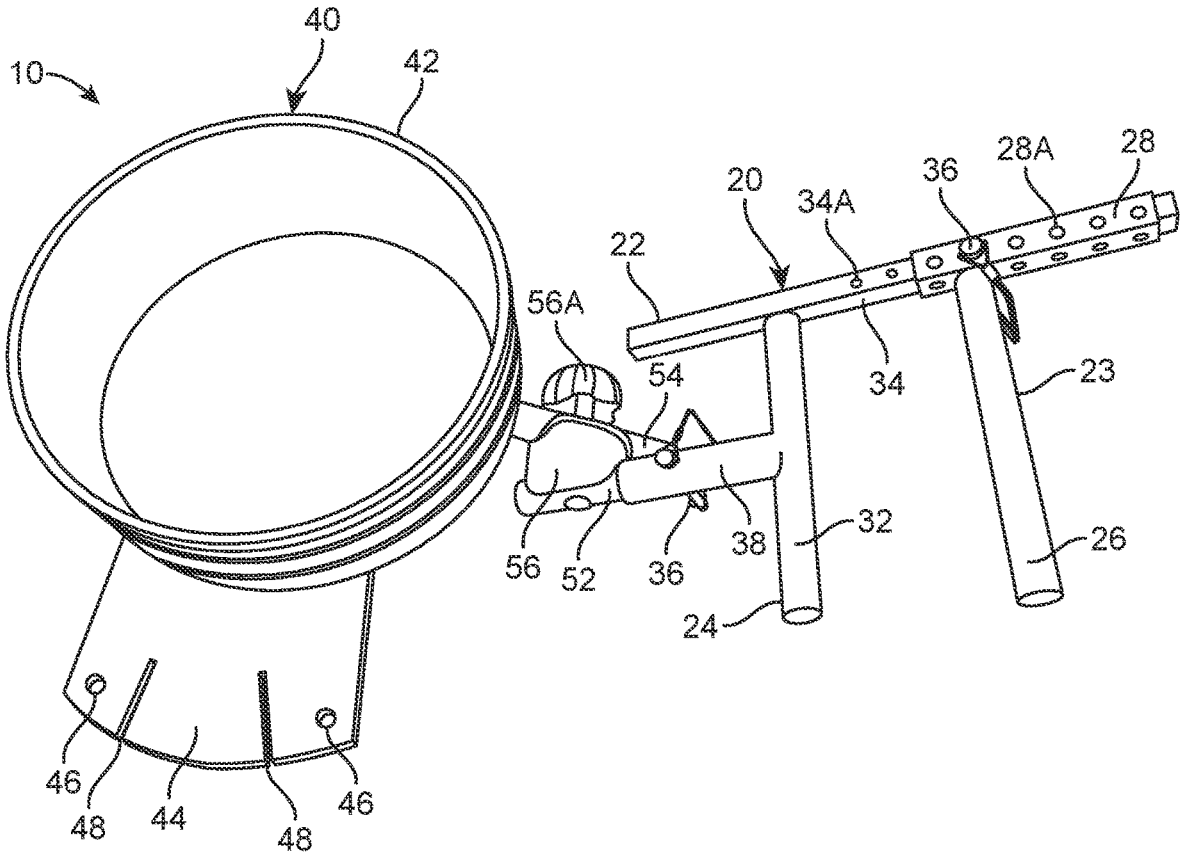
FIG. 2 shows an isometric view of the tool holder 10.
Figure 3:
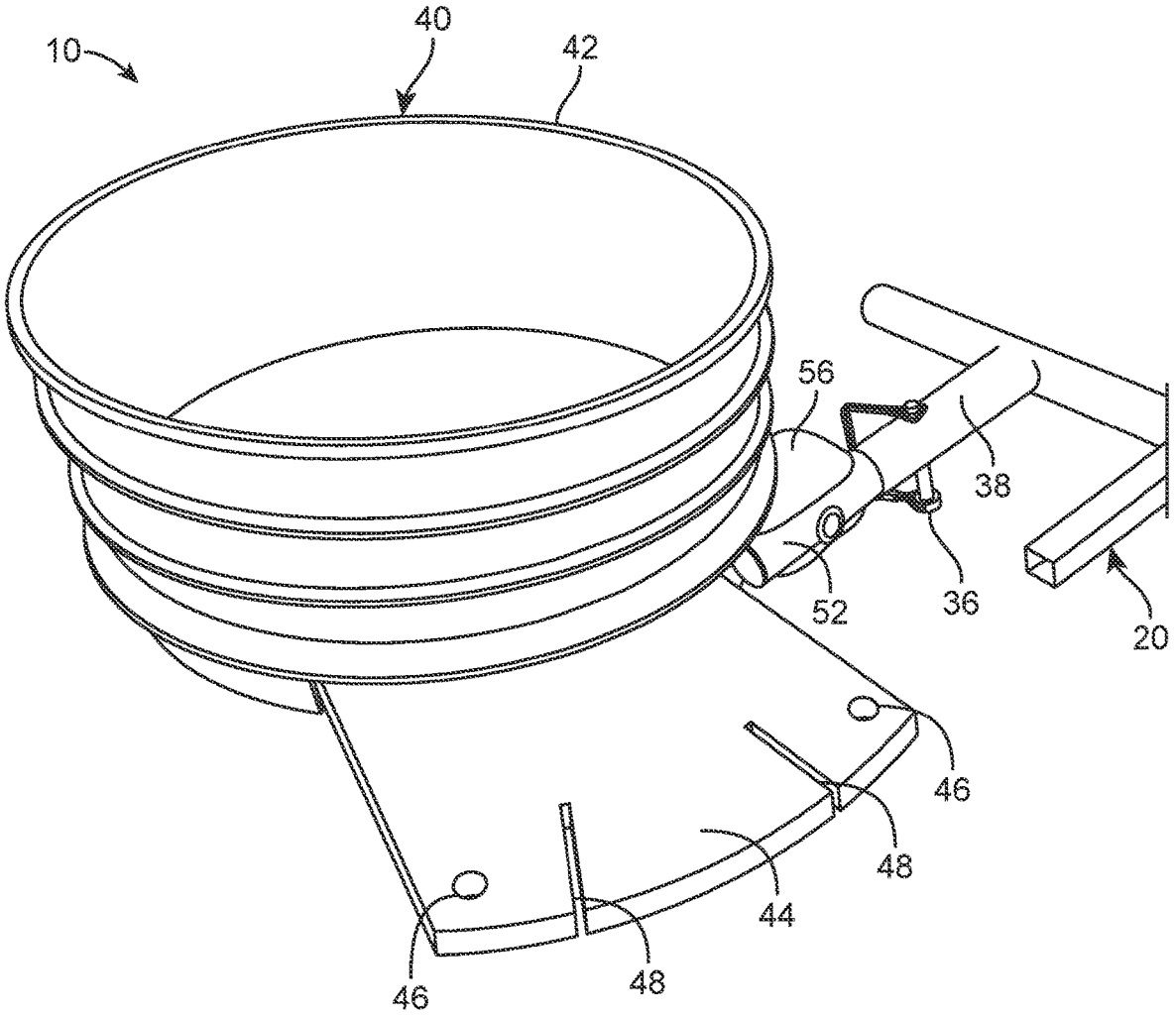
FIG. 3 illustrates a zoomed in view of the shelf 44.

Tool holder 10, as best seen in FIGS. 1-3, may help users to maintain a bucket 62 and tools 64 readily available. Thereby allowing the user to work more efficiently and effectively for improved job completion times. Additionally, tool holder 10 helps to maintain tools 64 more organized. Which also facilitates completing of necessary work tasks efficiently. As tools 64 are supported on tool holder 10, the users are relieved of the duties of carrying work equipment themselves, which is often heavy. Tool holder 10 may further be easy to assemble.

Tool holder 10 may include bracket assembly 20. Bracket assembly 20 may include a bracket 22. Bracket 22 may be suitable to use to secure tool holder 10 to a wall W. It is to be understood that bracket 22 may engage a laterals side of wall W. Bracket 22 may be engage wall W with sufficient pressure to prevent bracket 22 from sliding down wall W. Bracket 22 may be quickly disassembled for ease of storing. Bracket 22 may be made of materials such as metal, aluminum, wood, plastic, rubber, carbon fiber, fiberglass or the like. Preferably, bracket 22 may be lightweight. In one implementation, bracket 22 may be hollow.

Bracket 22 may be defined by a first tubular bar 23 and a second tubular bar 24. First tubular bar 23 and second tubular bar 24 may engage one another when bracket 22 is assembled for usage. First tubular bar 23 and second tubular bar 24 may have unique shapes that differ from each other. First tubular bar 23 may include a first rod 26. Second tubular bar 24 may include a second rod 32. It is to be understood that first tubular bar 23 and first rod 26 may be perpendicular to each other. It is to be understood that second tubular bar 24 and second rod 32 may be perpendicular to each other. First rod 26 and second rod 32 may be parallel to each other. Wall W may be received in between first rod 26 and second rod 32. First rod 26 and second rod 32 may be spaced apart depending on a width of wall W. First rod 26 and second rod 32 may extend horizontally along wall W. Thereby first rod 26 may be on one side of wall W and second rod 32 may be on an opposite side of wall W. It is to be understood that first rod 26 and second rod 32 may be in constant abutting contact with wall W when secured thereto. First rod 26 and second rod 32 may extend a partial length of wall W. Each of first rod 26 and second rod 32 may be cylindrical shaped, preferably.

First tubular bar 23 may further include a female member 28. Female member 28 may be hollow, preferably. Female member 28 may be perpendicularly secured to a distal end of first rod 26. Female member 28 may have a rectangular configuration, in one embodiment. It can be seen the female member 28 may include female member apertures 28A in line with each other along each side of female member 28. It may be suitable for female member apertures 28A to be located on opposite sides of female member 28. Female member apertures 28A may be evenly spaced apart and parallel to each other on female member 28.

Second tubular bar 24 may further include a male member 34. Male member 34 may be perpendicularly secured to a distal end of second rod 32. Male member 34 may have a configuration that cooperates with female member 28. Preferably, male member 34 may have a rectangular configuration. Male member 34 may include male member apertures 34A. Male member apertures 34A may extend in line with each other along a top side of male member 34. Female member 28 may receive male member 34 within, when first tubular bar 23 and second tubular bar 24 are engaged together to assemble bracket 22. Male member 34 may slide within female member 28 until proper sizing is achieved.

It is to be understood that female member apertures 28A and male member apertures 34A may align with each other when female member 28 and male member 34 are secured together. Female member apertures 28A and male member apertures 34A may be aligned when there is sufficient spacing defined between first rod 26 and second rod 32. First tubular bar 23 and second tubular bar 24, more specifically, female member 28 and male member 34 may be secured together with pins 36. Pins 36 may extend through female member 28 and male member 34 simultaneously. Pins 36 may extend through female member apertures 28A and male member apertures 34A simultaneously when bracket 22 is assembled. It is to be understood that pins 36 may alternatively be a fastener such as a screw, nail or the like. In one embodiment, it may be suitable for pins 36 to each include a handle. The handle may preferably be U shaped. The handle may extend from one distal end to an opposite distal end of each of pins 36.

It is to be understood that receptacle assembly 40 may be secured to bracket 22. Extending perpendicularly from second rod 32 may be a support post 38. It is to be understood that support post 38 may be centrally located on and extending away from second rod 32. Support post 38 may preferably be cylindrical in shape and hollow. Receptable assembly 40 may be detachably secured to support post 38. Additional of pins 36 may be used to secure receptable assembly 40 to support post 38.

Receptacle assembly 40, as best illustrated in FIGS. 1-3, may be used to support work supplies such as bucket 62 and tools 64. With supplies readily available, users are able to work more efficiently, as less time is wasted gathering the needed supplies. Receptacle assembly 40 may include a receptacle shelf 42. Receptacle shelf 42 may provide a support surface to the user. Items or supplies may be held within receptacle shelf 42 on the provided support surface. Receptacle shelf 42 may preferably have a cylindrical configuration which has sidewalls which extend vertically. Receptacle shelf 42 may include ridges extending about a perimeter thereof. The ridges may help to facilitate gripping, maneuvering or carrying of receptacle shelf 42. The ridges may preferably be evenly spaced apart and parallel to each other. It is to be understood that preferably, bucket 62 may be received and held within receptacle shelf 42. Bucket 62 may have a height greater than that of receptacle shelf 42.

Extending from receptacle shelf 42 may be a shelf 44. Shelf 44 may extend outwardly and away from receptacle shelf 42. Shelf 44 may be entirely underneath of receptacle shelf 42, in the preferred embodiment. Shelf 44 may be perpendicular to receptacle shelf 42. It is to be understood that shelf 44 may have a tapered configuration and be flat. Items such as tools 64 or other needed supplies may be supported on shelf 44. Thereby tools 62 and supplies remain readily available for usage during the completion of work tasks.

Shelf 44 may include openings 46 and slits 48 at a front end thereof. Openings 46 and slits 48 may be used to secured some of tools 64 to shelf 44. Importantly, tools secured within opening 46 and slits 48 may be secured vertically. Tools 64 such as screw drivers may be secured within openings 46. Openings 46 on shelf 44 may be parallel to each other. Slits 48 may extend a partial length of shelf 44. Tools 64 such as spatulas or trowels may be secured within slits 48.

To secure receptacle shelf 42 to bracket 22, receptacle assembly 40 may include a first support tube 52 and a second support tube 54. First support tube 52 and second support tube 54 may be cylindrical in one implementation. First support tube 52 may be removably secured to support post 38 with pins 36. Second support tube 54 may be secured to first support tube 52 at one end and to receptacle shelf 42 at an opposite end. First support tube 52 and second support tube 54 may be interconnected with a joint 56. Joint 56 may be located between first support tube 52 and second support tube 54. More specifically, joint 56 may be secured to a side of each of first support tube 52 and second support tube 54. First support tube 52 may be located on one side of joint 56 and second support tube 54 may be secured to an opposite side of joint 56. Joint 56 may permit adjusting of first support tube 52 and second support tube 54 at a desired angle relative to each other. Thereby resulting in receptacle shelf 42 being capable of being angled as needed as receptacle shelf 42 is secured to a distal end of second support tube 54. Receptacle shelf 42 is capable of being lowered or raised with joint 56. A joint knob 56A may be secured to knob 56. Joint knob 56A may be actuated to achieve the desired angle between first support tube 52 and second support tube 54. Joint knob 56A helps to facilitate setting joint 56 at the desired angle. Joint knob 56A may be loosened or tightened to release or secure first support tube 52 and second support tube 54.

Tool holder 10 may be portable to allow securing to any existing wall W. Allowing users to remain organized and efficient in completing work tasks. Bucket 62 and tools 64 may remain readily available to the user. Importantly, the present invention is compact to remain portable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a tool holder, comprising:

a. a bucket;

b. tools;

c. a bracket assembly including a bracket, said bracket defined by a first tubular bar and a second tubular bar, said first tubular bar and said second tubular bar slidably engaging each other, said first tubular bar having a first rod extending therefrom, said second tubular bar having a second rod extending therefrom, said bracket is configured to be secured to a wall, said first rod and said second rod are configured to receive said wall therebetween, said second rod including a support post extending therefrom; and d. a receptacle assembly including a receptacle shelf, said bucket received and supported within said receptacle shelf, a shelf extending outwardly and away from said receptacle shelf, said tools removably secured to said shelf, a first support tube and a second support tube secured together with a joint and being angularly adjustable relative to each other, said first support tube being secured to said support post at a distal end thereof, said second support tube secured to said receptacle shelf at a distal end thereof.

2. The system of claim 1, wherein said first rod and said second rod are perpendicular to said first tubular bar and said second tubular bar, respectively.

3. The system of claim 1, wherein said first rod and said second rod are parallel to each other.

4. The system of claim 1, wherein a spacing defined between said first rod and said second rod is adjustable.

5. The system of claim 1, wherein said support being centrally located and perpendicular to said second rod.

6. The system of claim 1, wherein said first tubular member includes a female member and said second tubular member includes a male member, said male member being slidably received within said female member.

7. The system of claim 6, wherein said female member is perpendicular to said first rod.

8. The system of claim 6, wherein said male member is perpendicular to said second rod.

9. The system of claim 6, wherein said female member includes female member apertures and said male member includes male member apertures.

10. The system of claim 9, wherein said female member apertures are aligned with said male member apertures, at least one pin extends through said female member apertures and said male member apertures simultaneously to secure said first tubular bar and said second tubular member together to assemble said bracket to a size configured to accommodate said wall therebetween.

11. The system of claim 1, wherein said shelf includes openings, said tools being received within said openings to secure said tools to said shelf.

12. The system of claim 11, wherein said openings are parallel to each other.

13. The system of claim 11, wherein said shelf includes slits, said tools being received within said slits to secure said tools to said shelf.

14. The system of claim 13, wherein said slits are located between said openings.

15. The system of claim 1, wherein said bucket is partially exposed within said receptacle shelf, said bucket has a height greater than said receptacle shelf.

16. The system of claim 1, wherein said joint includes a joint knob, said joint knob adjusting and securing the angle between said first support tube and said second support tube to raise or lower said receptacle shelf.

17. The system of claim 10, wherein an additional of said at least one pin secures said first support tube to said support post.

18. The system of claim 9, wherein said female member includes said female member apertures on at least one side thereof.

19. A system for a tool holder, comprising:

a. a bucket;

b. tools;

c. a bracket assembly including a bracket, said bracket defined by a first tubular bar and a second tubular bar, said first tubular bar and said second tubular bar slidably engaging each other, said first tubular bar having a first rod extending perpendicularly therefrom, said second tubular bar having a second rod extending perpendicularly therefrom, said first rod and said second rod being parallel to each other, said bracket is configured to be secured to a wall, said first rod and said rod are configured to receive said wall therebetween, said first rod and said second rod is configured to be in constant abutting contact with said wall, said bracket is configured to be in abutting contact with a lateral side of said wall, said second rod including a support post extending perpendicularly therefrom, said first tubular bar including a female member at a distal end thereof, said female member including female member apertures, said second tubular bar including a male member at a distal end thereof, said male member including male member apertures, said female member apertures aligned with said male member apertures, at least one pin extends through said female member apertures and said male member apertures simultaneously to secure said first tubular bar and said second tubular member together to assemble said bracket to a size configured to accommodate said wall therebetween; and d. a receptacle assembly including a receptacle shelf, said bucket received and supported within said receptacle shelf, a shelf extending outwardly and away from said receptacle shelf, said tools removably secured to said shelf, a first support tube and a second support tube secured together with a joint and being angularly adjustable relative to each other with a joint knob to lower and raise said receptacle shelf, said first support tube being secured to said support post at a distal end of said support post with an additional of said at least one pin, said second support tube secured to said receptacle shelf at a distal end thereof, said shelf including openings and slits, said slits being between said openings, said tools secured to said shelf within said openings and slits.

20. A system for a tool holder, consisting of:

a. a bucket;

b. tools;

c. a bracket assembly including a bracket, said bracket defined by a first tubular bar and a second tubular bar, said first tubular bar and said second tubular bar slidably engaging each other, said first tubular bar having a first rod extending perpendicularly therefrom, said second tubular bar having a second rod extending perpendicularly therefrom, said first rod and said second rod being parallel to each other, said bracket is configured to be secured to a wall, said first rod and said rod are configured to receive said wall therebetween, said first rod and said second rod are configured to be in constant abutting contact with said wall, said bracket is configured to be in abutting contact with a lateral side of said wall, said second rod including a support post extending perpendicularly therefrom, said first tubular bar including a female member at a distal end thereof, said female member including female member apertures, said second tubular bar including a male member at a distal end thereof, said male member including male member apertures, said female member apertures aligned with said male member apertures, at least one pin extends through said female member apertures and said male member apertures simultaneously to secure said first tubular bar and said second tubular member together to assemble said bracket to a size configured to accommodate said wall therebetween; and d. a receptacle assembly including a receptacle shelf, said bucket received and supported within said receptacle shelf, a shelf extending outwardly and away from said receptacle shelf, said tools removably secured to said shelf, a first support tube and a second support tube secured together with a joint and being angularly adjustable relative to each other with a joint knob to lower and raise said receptacle shelf, said first support tube being secured to said support post at a distal end of said support post with an additional of said at least one pin, said second support tube secured to said receptacle shelf at a distal end thereof, said shelf including openings and slits, said slits being between said openings, said tools secured to said shelf within said openings and slits.

* * * * *